US011017724B2

(12) United States Patent
Park

(10) Patent No.: US 11,017,724 B2
(45) Date of Patent: May 25, 2021

(54) GATE DRIVING CIRCUIT AND DISPLAY APPARATUS HAVING THE SAME

(71) Applicant: Samsung Display Co., Ltd., Yongin-si (KR)

(72) Inventor: Kyung-ho Park, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/843,737

(22) Filed: Apr. 8, 2020

(65) Prior Publication Data

US 2020/0349892 A1 Nov. 5, 2020

(30) Foreign Application Priority Data

May 2, 2019 (KR) ..... 10-2019-0051686

(51) Int. Cl.
*G09G 3/3266* (2016.01)

(52) U.S. Cl.
CPC ... *G09G 3/3266* (2013.01); *G09G 2300/0809* (2013.01)

(58) Field of Classification Search
CPC ..... G09G 3/20; G09G 3/2092; G09G 3/3266; G09G 3/3275; G09G 2300/0426; G09G 2300/0809; G09G 2310/0267; G09G 2310/0275; G09G 2310/08; G09G 2320/0673; G09G 2330/08; G09G 2330/12; G09G 3/006; G09G 3/3674; G09G 2320/04
See application file for complete search history.

(56) References Cited

U.S. PATENT DOCUMENTS

| | | | | |
|---|---|---|---|---|
| 8,493,376 | B2 | 7/2013 | Su et al. | |
| 9,704,448 | B2 | 7/2017 | Xie et al. | |
| 10,121,434 | B2 * | 11/2018 | Park | G11C 19/28 |
| 2007/0216634 | A1 * | 9/2007 | Kim | G09G 3/3677 345/100 |
| 2018/0337682 | A1 * | 11/2018 | Takasugi | G09G 3/3241 |

FOREIGN PATENT DOCUMENTS

KR 10-2008-0033730 A 4/2008

* cited by examiner

*Primary Examiner* — Nelson M Rosario
(74) *Attorney, Agent, or Firm* — Lewis Roca Rothgerber Christie LLP

(57) ABSTRACT

A gate driving circuit includes a plurality of stages. Adjacent two stages from among the plurality of stages constitute a stage pair. The adjacent two stages in the stage pair include switching elements connected with each other. When a carry signal of an N-th stage in the stage pair has a defect, the N-th stage is configured to output a carry signal of an (N+1)-th stage in the stage pair. N is a positive integer. When a defect has occurred at a carry signal of a stage in a stage pair, the carry signal of the stage having the defect may be repaired by a carry signal of another stage in the stage pair.

17 Claims, 14 Drawing Sheets

GATE DRIVING CIRCUIT AND DISPLAY APPARATUS HAVING THE SAME

CROSS-REFERENCE TO RELATED APPLICATION

This application claims priority to and the benefit of Korean Patent Application No. 10-2019-0051686, filed on May 2, 2019 in the Korean Intellectual Property Office KIPO, the contents of which are herein incorporated by reference in their entireties.

BACKGROUND

1. Field

Exemplary embodiments of the present inventive concept relate to a gate driving circuit and a display apparatus including the gate driving circuit.

2. Description of the Related Art

A display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver.

The gate driver includes a plurality of stages. A stage operates in response to a carry signal received from another stage. When a defect of the carry signal occurs, the gate driver may not operate properly, thus the gate driver and the display panel, which is formed integrally with the gate driver, may need to be discarded.

SUMMARY

Exemplary embodiments of the present inventive concept provide a gate driving circuit repairing a carry signal to reduce manufacturing costs and a display apparatus including the gate driving circuit.

Exemplary embodiments of the present inventive concept relate to a gate driving circuit capable of repairing a defect of a carry signal output part of a stage using a carry signal of another stage and a display apparatus including the gate driving circuit.

In an exemplary embodiment of a gate driving circuit according to the present inventive concept, the gate driving circuit includes a plurality of stages. Adjacent two stages from among the plurality of stages constitute a stage pair. The adjacent two stages in the stage pair include switching elements connected with each other. When a carry signal of an N-th stage in the stage pair has a defect, the N-th stage is configured to output a carry signal of an (N+1)-th stage in the stage pair. N is a positive integer.

In an exemplary embodiment, the N-th stage may include a Q node charging circuit configured to charge a Q node based on one of previous carry signals, a Q node stabilizing circuit configured to stabilize the Q node based on one of next carry signals, a carry signal output circuit configured to output a carry signal based on a Q node signal of the Q node, a sensing signal output circuit configured to output a sensing signal based on the Q node signal and a gate signal output circuit configured to output a gate signal based on the Q node signal.

In an exemplary embodiment, the Q node charging circuit may include a first charging switching element including a control electrode configured to receive one of the previous carry signals, an input electrode configured to receive one of the previous carry signals and an output electrode connected to an input electrode of a second charging switching element and the second charging switching element including a control electrode configured to receive one of the previous carry signals, the input electrode connected to the output electrode of the first charging switching element and an output electrode connected to the Q node.

In an exemplary embodiment, one of the previous carry signals may be a carry signal of a third previous stage from a present stage.

In an exemplary embodiment, the Q node stabilizing circuit may include a first stabilizing switching element including a control electrode configured to receive a fifth input signal, an input electrode connected to an output electrode of a second stabilizing switching element and an output electrode configured to receive a first low voltage, the second stabilizing switching element including a control electrode configured to receive the fifth input signal, an input electrode connected to the Q node and the output electrode connected to the input electrode of the first stabilizing switching element, a third stabilizing switching element including a control electrode configured to receive one of the next carry signals, an input electrode connected to an output electrode of a fourth stabilizing switching element and an output electrode configured to receive the first low voltage and the fourth stabilizing switching element including a control electrode configured to receive one of the next carry signals, an input electrode connected to the Q node and the output electrode connected to the input electrode of the third stabilizing switching element.

In an exemplary embodiment, when a present stage is the N-th stage, one of the next carry signals may be a carry signal of a fourth next stage from the present stage.

In an exemplary embodiment, when a present stage is the (N+1)-th stage, one of the next carry signals may be a carry signal of a third next stage from the present stage.

In an exemplary embodiment, the gate driving circuit may include first, second, third, fourth, fifth, sixth, seventh, eighth, ninth and tenth stages which are sequentially disposed. When a carry signal of the fifth stage and a carry signal of the sixth stage are in a normal status, the carry signal of the fifth stage may be applied to a Q node stabilizing circuit of the first stage, a Q node stabilizing circuit of the second stage and a Q node charging circuit of the eighth stage and the carry signal of the sixth stage may be applied to a Q node charging circuit of the ninth stage.

In an exemplary embodiment, when the carry signal of the fifth stage has a defect and the carry signal of the sixth stage is in a normal status, the carry signal of the sixth stage may be applied to the Q node stabilizing circuit of the first stage, the Q node stabilizing circuit of the second stage, the Q node charging circuit of the eighth stage and the Q node charging circuit of the ninth stage.

In an exemplary embodiment, when the carry signal of the fifth stage has a defect and the carry signal of the sixth stage is in a normal status, a carry signal output terminal of the fifth stage may be opened and a carry transmitting line of the fifth stage and a carry transmitting line of the sixth stage may be shorted at a cross point of the carry transmitting line of the fifth stage and the carry transmitting line of the sixth stage.

In an exemplary embodiment, when the carry signal of the fifth stage is in a normal status and a carry signal of the sixth stage has a defect, the carry signal of the fifth stage may be applied to the Q node stabilizing circuit of the first stage, the Q node stabilizing circuit of the second stage, the Q node charging circuit of the eighth stage and the Q node charging circuit of the ninth stage.

In an exemplary embodiment, when the carry signal of the fifth stage is in a normal status and a carry signal of the sixth stage has a defect, a carry signal output terminal of the sixth stage may be opened and a carry transmitting line of the fifth stage and a carry transmitting line of the sixth stage may be shorted at a cross point of the carry transmitting line of the fifth stage and the carry transmitting line of the sixth stage.

In an exemplary embodiment, the carry signal output circuit may include a first carry switching element including a control electrode connected to the Q node, an input electrode configured to receive a carry clock signal and an output electrode connected to a carry signal output terminal, a second carry switching element including a control electrode configured to receive an inverting signal of the (N+1)-th stage, an input electrode connected to the carry signal output terminal and an output electrode configured to receive a first low voltage and a third carry switching element including a control electrode configured to receive the inverting signal of the N-th stage, an input electrode connected to the carry signal output terminal and an output electrode configured to receive the first low voltage.

In an exemplary embodiment, the sensing signal output part may include a first sensing output switching element including a control electrode connected to the Q node, an input electrode configured to receive a sensing clock signal and an output electrode connected to a sensing signal output terminal, a second sensing output switching element including a control electrode configured to receive an inverting signal of the (N+1)-th stage, an input electrode connected to the sensing signal output terminal and an output electrode configured to receive a third low voltage and a third sensing output switching element including a control electrode configured to receive an inverting signal of the N-th stage, an input electrode connected to the sensing signal output terminal and an output electrode receiving the third low voltage.

In an exemplary embodiment, the gate signal output part may include a first gate switching element including a control electrode connected to the Q node, an input electrode configured to receive a gate clock signal and an output electrode connected to a gate signal output terminal, a second gate switching element including a control electrode configured to receive an inverting signal of the (N+1)-th stage, an input electrode connected to the gate signal output terminal and an output electrode configured to receive a third low voltage and a third gate switching element including a control electrode configured to receive an inverting signal of the N-th stage, an input electrode connected to the gate signal output terminal and an output electrode configured to receive the third low voltage.

In an exemplary embodiment of a display apparatus according to the present inventive concept, the display apparatus includes a display panel, a gate driver and a data driver. The gate driver includes a plurality of stages. Adjacent two stages from among the plurality of stages constitute a stage pair. The adjacent two stages in the stage pair include switching elements connected with each other. When a carry signal of an N-th stage in the stage pair has a defect, the N-th stage is configured to output a carry signal of an (N+1)-th stage in the stage pair. N is a positive integer.

In an exemplary embodiment, the N-th stage may include a Q node charging circuit configured to charge a Q node based on one of previous carry signals, a Q node stabilizing circuit configured to stabilize the Q node based on one of next carry signals, a carry signal output circuit configured to output a carry signal based on a Q node signal of the Q node, a sensing signal output circuit configured to output a sensing signal based on the Q node signal and a gate signal output circuit configured to output a gate signal based on the Q node signal.

In an exemplary embodiment, the Q node charging circuit may include a first charging switching element including a control electrode configured to receive one of the previous carry signals, an input electrode configured to receive one of the previous carry signals and an output electrode connected to an input electrode of a second charging switching element and the second charging switching element including a control electrode configured to receive one of the previous carry signals, the input electrode connected to the output electrode of the first charging switching element and an output electrode connected to the Q node.

In an exemplary embodiment, the Q node stabilizing circuit may include a first stabilizing switching element including a control electrode configured to receive a fifth input signal, an input electrode connected to an output electrode of a second stabilizing switching element and an output electrode configured to receive a first low voltage, the second stabilizing switching element including a control electrode configured to receive the fifth input signal, an input electrode connected to the Q node and the output electrode connected to the input electrode of the first stabilizing switching element, a third stabilizing switching element including a control electrode configured to receive one of the next carry signals, an input electrode connected to an output electrode of a fourth stabilizing switching element and an output electrode configured to receive the first low voltage and the fourth stabilizing switching element including a control electrode configured to receive one of the next carry signals, an input electrode connected to the Q node and the output electrode connected to the input electrode of the third stabilizing switching element.

According to the gate driving circuit and the display apparatus including the gate driving circuit, when a defect is occurred at a carry signal of a stage in a stage pair, the carry signal of the stage having the defect may be repaired by a carry signal of another stage in the stage pair. Thus, the gate driving circuit having the defected carry signal output part and a structure including the gate driving circuit may not be discarded. Thus, the manufacturing cost of the display apparatus may be reduced.

BRIEF DESCRIPTION OF THE DRAWINGS

The above and other features and aspects of the present inventive concept will become more apparent by describing in detailed exemplary embodiments thereof with reference to the accompanying drawings, in which.

DETAILED DESCRIPTION

Figure 1:
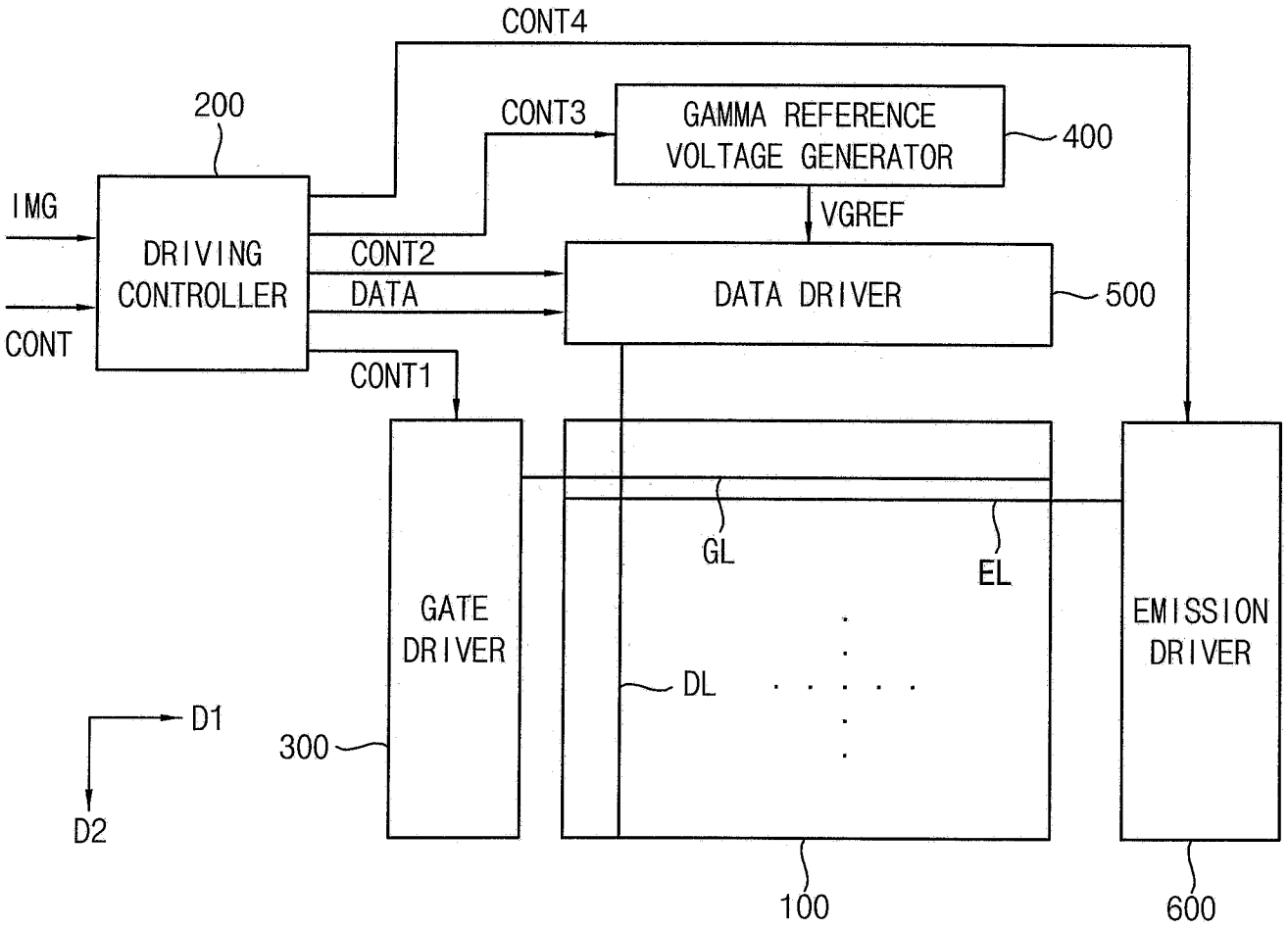
FIG. 1 is a block diagram illustrating a display apparatus according to an exemplary embodiment of the present inventive concept.

Hereinafter, the present inventive concept will be explained in detail with reference to the accompanying drawings.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The display apparatus and/or any other relevant devices or components according to embodiments of the present invention described herein may be implemented utilizing any suitable hardware, firmware (e.g., an application-specific integrated circuit), software, or a combination of software, firmware, and hardware. For example, the display apparatus includes a display panel and a display panel driver. The display panel driver includes a driving controller, a gate driver, a gamma reference voltage generator, a data driver and an emission driver. The various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200, a gate driver 300, a gamma reference voltage generator 400, a data driver 500 and an emission driver 600.

The display panel 100 has a display region on which an image is displayed and a peripheral region adjacent to the display region.

The display panel 100 includes a plurality of gate lines GL, a plurality of data lines DL, a plurality of emission lines EL and a plurality of pixels electrically connected to the gate lines GL, the data lines DL and the emission lines EL. The gate lines GL may extend in a first direction D1, the data lines DL may extend in a second direction D2 crossing the first direction D1 and the emission lines EL may extend in the first direction D1.

For example, the display panel 100 may be an organic light emitting panel including organic light emitting diodes.

The driving controller 200 receives input image data IMG and an input control signal CONT from an external apparatus. For example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GL in response to the first control signal CONT1 received from the driving controller 200. The gate driver 300 may sequentially output the gate signals to the gate lines GL.

For example, the gate driver 300 may be integrated on the display panel 100. For example, the gate driver 300 may be mounted on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

For example, the data driver 500 may be integrally formed with the driving controller 200 to form a timing controller embedded data driver TED.

The emission driver 600 generates emission signals to drive the emission lines EL in response to the fourth control signal CONT4 received from the driving controller 200. The emission driver 600 may output the emission signals to the emission lines EL.

Figure 2:
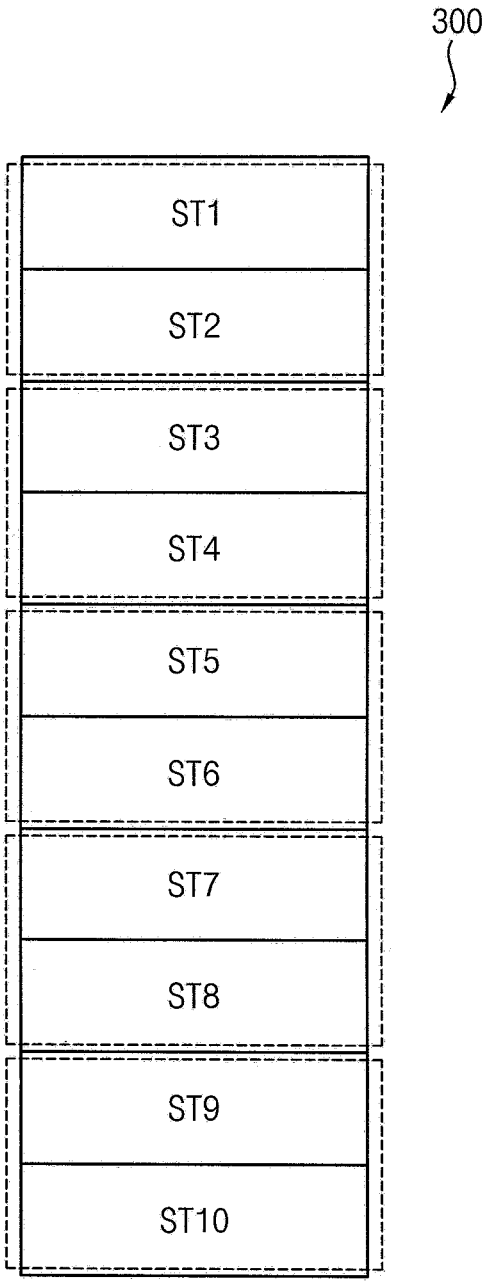
FIG. 2 is a block diagram illustrating stages of a gate driver of FIG. 1.

FIG. 2 is a block diagram illustrating stages ST1 to ST10 of the gate driver of FIG. 1.

Referring to FIGS. 1 and 2, the gate driver 300 may include a plurality of stages ST1 to ST10. Although ten stages are illustrated in FIG. 2 for convenience of explanation, the present inventive concept is not limited thereto. One stage may output one gate signal so that the number of the stages may correspond to the number of the gate lines. For example, the number of the stages may be equal to the number of the gate lines.

Adjacent two stages of the stages may form a stage pair. For example, a first stage pair may include a first stage ST1 and a second stage ST2. For example, a second stage pair may include a third stage ST3 and a fourth stage ST4. For example, a third stage pair may include a fifth stage ST5 and a sixth stage ST6. For example, a fourth stage pair may include a seventh stage ST7 and an eighth stage ST8. For example, a fifth stage pair may include a ninth stage ST9 and a tenth stage ST10.

Two stages in the stage pair may include switching elements connected (e.g., directly connected) with each other. In addition, the two stages in the stage pair may share at least one input signal.

Figure 3:
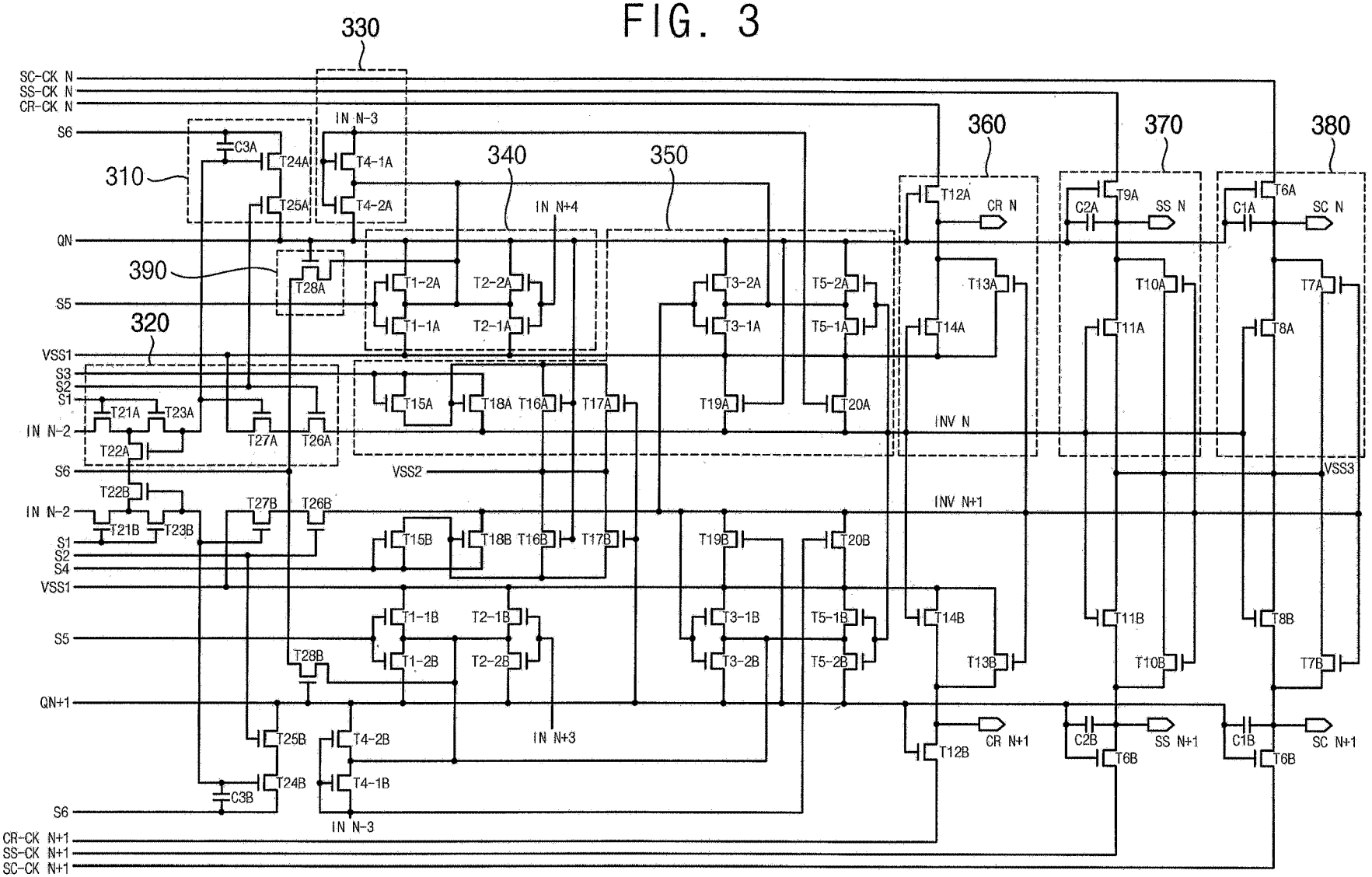
FIG. 3 is a circuit diagram illustrating an N-th stage and an (N+1)-th stage of the gate driver of FIG. 1.
Figure 4:
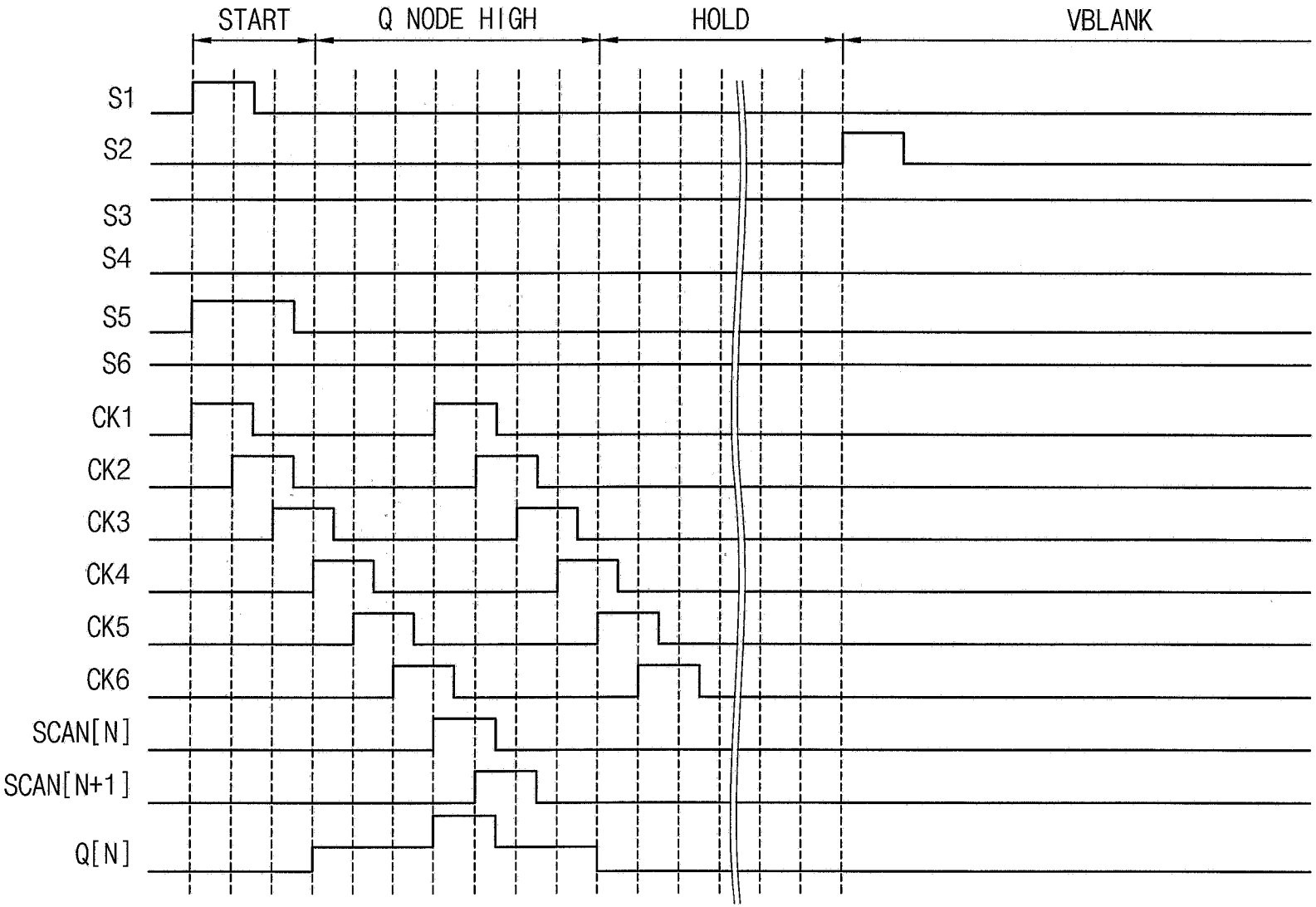
FIGS. 4 and 5 are timing diagrams illustrating input signals and output signals of the N-th stage and the (N+1)-th stage of the gate driver of FIG. 1.
Figure 5:
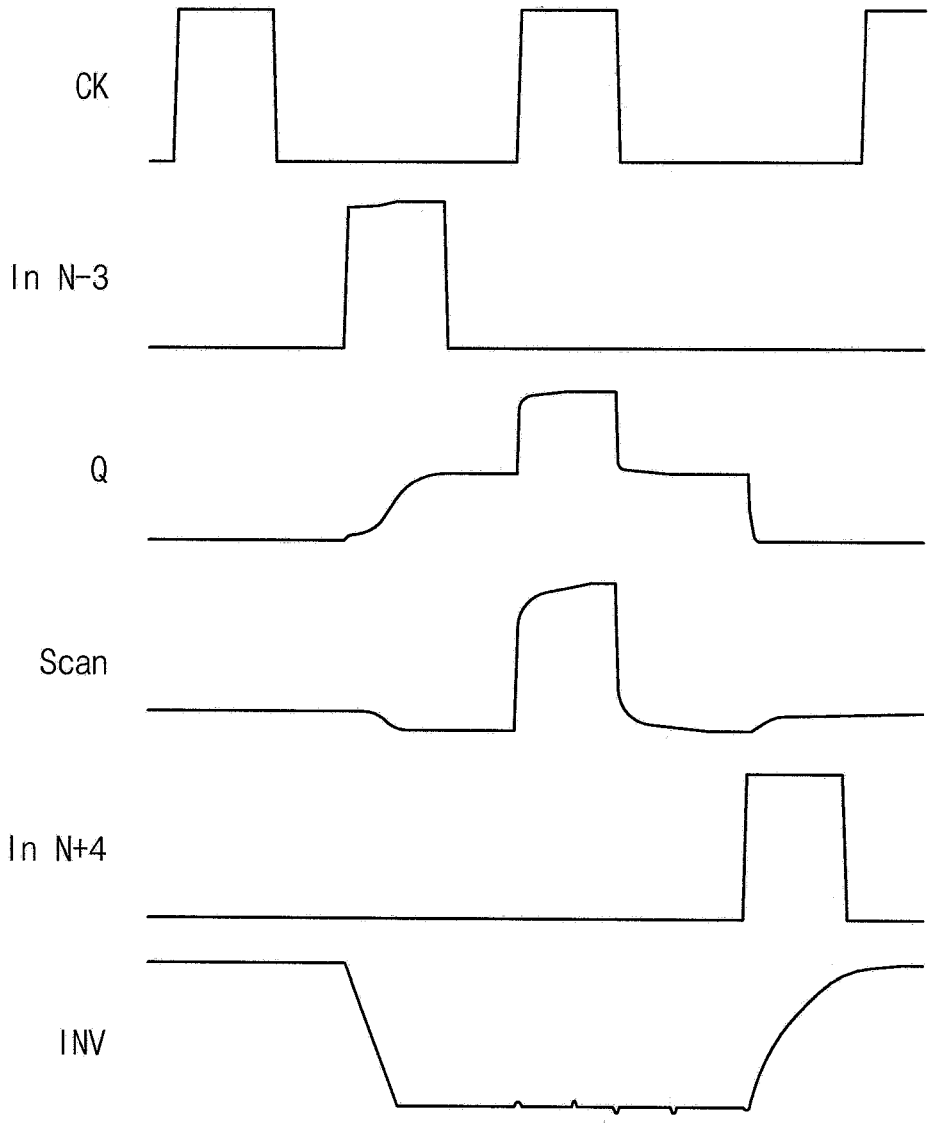

FIG. 3 is a circuit diagram illustrating an N-th stage and an (N+1)-th stage of the gate driver 300 of FIG. 1. FIGS. 4 and 5 are timing diagrams illustrating input signals and output signals of the N-th stage and the (N+1)-th stage of the gate driver 300 of FIG. 1.

Referring to FIGS. 1-5, the N-th stage and the (N+1)-th stage may form a stage pair. The N-th stage and the (N+1)-th stage may include switching elements connected (e.g., directly connected) with each other. In addition, the N-th stage and the (N+1)-th stage may share at least one input signal.

First to sixth input signals S1 to S6, an N-th clock signal and first to third low voltages VSS1, VSS2 and VSS3 may be applied to the N-th stage. The N-th clock signal may include a gate clock signal SC-CK, a sensing clock signal SS-CK and a carry clock signal CR-CK. In an active period, the gate clock signal SC-CK, the sensing clock signal SS-CK and the carry clock signal CR-CK may have the same timing so that the gate clock signal SC-CK, the sensing clock signal SS-CK and the carry clock signal CR-CK are represented as a single clock signal CK in FIGS. 4 and 5 for convenience of explanation. Although the third input signal S3 has a high level and the fourth input signal S4 has a low level in FIG. 4, the third input signal S3 and the fourth input signal S4 may be inverted in every frame. Thus, the third input signal S3 may have a low level and the fourth input signal S4 may have a high level in next frame.

Six clock signals CK1 to CK6 having different phases with each other may be sequentially applied to the stages of the gate driver 300. Each of the clock signals CK1 to CK6 may have a cycle of six horizontal periods.

For example, a first clock signal CK1 is applied to a first stage ST1, a second clock signal CK2 is applied to a second stage ST2, a third clock signal CK3 is applied to a third stage ST3, a fourth clock signal CK4 is applied to a fourth stage ST4, a fifth clock signal CK5 is applied to a fifth stage ST5, a sixth clock signal CK6 is applied to a sixth stage ST6, the first clock signal CK1 is applied to a seventh stage ST7, the second clock signal CK2 is applied to an eighth stage ST8, the third clock signal CK3 is applied to a ninth stage ST9, the fourth clock signal CK4 is applied to a tenth stage ST10, the fifth clock signal CK5 is applied to an eleventh stage ST11 and the sixth clock signal CK6 is applied to a twelfth stage ST12.

The N-th stage may include a first sensing part 310, a second sensing part 320, a Q node charging part 330, a Q node stabilizing part 340, an inverting part 350, a carry signal output part 360, a sensing signal output part 370, a gate signal output part 380 and a switching element stabilizing part 390.

The first sensing part 310 and the second sensing part 320 may operate based on the first input signal S1, the second input signal S2, the sixth input signal S6 and a Q node signal QN. The first sensing part 310 and the second sensing part 320 may sense a characteristic of a switching element in a pixel part of the display panel 100.

The first sensing part 310 includes a first sensing switching element T24A, a second sensing switching element T25A and a sensing capacitor C3A.

The sensing capacitor C3A may include a first electrode receiving the sixth input signal S6 and a second electrode connected to a control electrode of the first sensing switching element T24A.

The first sensing switching element T24A may include the control electrode connected to the second electrode of the sensing capacitor C3A, an input electrode receiving the sixth input signal S6 and an output electrode connected to an input electrode of the second sensing switching element T25A.

The second sensing switching element T25A may include a control electrode receiving the second input signal S2, the input electrode connected to the output electrode of the first sensing switching element T24A and an output electrode connected to a Q node QN.

The second sensing part 320 may include a third sensing switching element T21A, a fourth sensing switching element T22A, a fifth sensing switching element T23A, a sixth sensing switching element T26A and a seventh sensing switching element T27A.

The third sensing switching element T21A may include a control electrode receiving the first input signal S1, an input electrode receiving one (e.g. an (N−2)-th carry signal CR N−2, IN N−2) of previous carry signals and an output electrode connected to an input electrode of the fourth sensing switching element T22A.

The fourth sensing switching element T22A may include a control electrode connected to an output electrode of the fifth sensing switching element T23A, an input electrode connected to the input electrode of the third sensing switching element T21A and an output electrode connected to an output electrode of a fourth sensing switching element T22B of an (N+1)-th stage.

The fifth sensing switching element T23A may include a control electrode receiving the first input signal S1, an input electrode connected to the output electrode of the third sensing switching element T21A and the output electrode connected to the control electrode of the fourth sensing switching element T22A.

The sixth sensing switching element T26A may include a control electrode receiving the second input signal S2, an input electrode connected to an output electrode of the seventh sensing switching element T27A and an output electrode connected to an output electrode of a tenth inverting switching element T18A.

The seventh sensing switching element T27A may include a control electrode connected to the output electrode of the fifth sensing switching element T23A, an input electrode receiving the first low voltage VSS1 and the output electrode connected to the input electrode of the sixth sensing switching element T26A.

The Q node charging part 330 charges the Q node QN based on one of the previous carry signals. Herein, the one of the previous carry signals may be a carry signal (CR N−3) of a third previous stage from (e.g., relative to) a present stage (N-th stage). The carry signal (CR N−3) of the third previous stage may be inputted through a terminal IN N−3.

The Q node charging part 330 may include a first charging switching element T4-1A and a second charging switching element T4-2A.

The first charging switching element T4-1A may include a control electrode receiving the one (CR N−3) of the previous carry signals, an input electrode receiving the one (CR N−3) of the previous carry signals and an output electrode connected to an input electrode of the second charging switching element T4-2A.

The second charging switching element T4-2A may include a control electrode receiving the one (CR N−3) of the previous carry signals, the input electrode connected to the output electrode of the first charging switching element T4-1A and an output electrode connected to the Q node QN.

The Q node stabilizing part 340 stabilizes the Q node QN based on the fifth input signal S5 and one of next carry signals. Herein, the one of the next carry signals may be a carry signal (CR N+4) of a fourth next stage from (e.g., relative to) the present stage (N-th stage). For example, the Q node stabilizing part 340 of a first stage (e.g. N-th stage) in the stage pair may receive the carry signal (CR N+4) of a fourth next stage from the present stage. The carry signal (CR N+4) of the fourth next stage may be inputted through a terminal In N+4 of the N-th stage. For example, the Q node stabilizing part 340 of a second stage (e.g. (N+1)-th stage) in the stage pair may receive the carry signal (CR N+4) of a third next stage from (e.g., relative to) the present stage. The carry signal (CR N+4) of the third next stage may be inputted through a terminal In N+3 of the (N+1)-th stage. Herein, the fifth input signal S5 may be a vertical start signal.

The Q node stabilizing part 340 may include a first stabilizing switching element T1-1A, a second stabilizing switching element T1-2A, a third stabilizing switching element T2-1A and a fourth stabilizing switching element T2-2A.

The first stabilizing switching element T1-1A may include a control electrode receiving the fifth input signal S5, an input electrode connected to an output electrode of the second stabilizing switching element T1-2A and an output electrode receiving the first low voltage VSS1.

The second stabilizing switching element T1-2A may include a control electrode receiving the fifth input signal S5, an input electrode connected to the Q node QN and the output electrode connected to the input electrode of the first stabilizing switching element T1-1A.

The third stabilizing switching element T2-1A may include a control electrode receiving the one (CR N+4) of the next carry signals, an input electrode connected to an output electrode of the fourth stabilizing switching element T2-2A and an output electrode receiving the first low voltage VSS1.

The fourth stabilizing switching element T2-2A may include a control electrode receiving one (CR N+4) of the next carry signals, an input electrode connected to the Q node QN and the output electrode connected to the input electrode of the third stabilizing switching element T2-1A.

The inverting part 350 may generate an inverting signal INV N based on the third input signal S3 and the Q node signal QN. The inverting part 350 may further receive an inverting signal INV N+1 of an (N+1)-th stage and a Q node signal QN+1 of the (N+1)-th stage.

The inverting part 350 may include a first inverting switching element T3-1A, a second inverting switching element T3-2A, a third inverting switching element T19A, a fourth inverting switching element T5-1A, a fifth inverting switching element T5-2A, a sixth inverting switching element T20A, a seventh inverting switching element T15A, an eighth inverting switching element T16A, a ninth inverting switching element T17A and a tenth inverting switching element T18A.

The carry signal output part 360 may output a carry signal CR N based on the Q node signal QN and the inverting signal INV N and INV N+1.

The carry signal output part 360 may include a first carry switching element T12A, a second carry switching element T13A and a third carry switching element T14A.

The first carry switching element T12A may include a control electrode connected to the Q node QN, an input electrode receiving the carry clock signal CR-CK N and an output electrode connected to a carry signal output terminal.

The second carry switching element T13A may include a control electrode receiving an inverting signal of the (N+1)-th stage, an input electrode connected to the carry signal output terminal and an output electrode receiving the first low voltage VSS1.

The third carry switching element T14A may include a control electrode receiving the inverting signal INV N, an input electrode connected to the carry signal output terminal and an output electrode receiving the first low voltage VSS1.

The sensing signal output part 370 may output a sensing signal SS N based on the Q node signal QN and the inverting signal INV N and INV N+1.

The sensing signal output part 370 may include a first sensing output switching element T9A, a second sensing output switching element T10A and a third sensing output switching element T11A.

The first sensing output switching element T9A may include a control electrode connected to the Q node QN, an input electrode receiving the sensing clock signal SS-CK N and an output electrode connected to a sensing signal output terminal.

The second sensing output switching element T10A may include a control electrode receiving an inverting signal INV N+1 of the (N+1)-th stage, an input electrode connected to the sensing signal output terminal and an output electrode receiving the third low voltage VSS3.

The third sensing output switching element T11A may include a control electrode receiving an inverting signal INV N, an input electrode connected to the sensing signal output terminal and an output electrode receiving the third low voltage VSS3.

The sensing signal output part 370 may further include a sensing output capacitor connected between the control electrode of the first sensing output switching element T9A and the output electrode of the first sensing output switching element T9A.

The gate signal output part 380 may output a gate signal SC N based on the Q node signal QN and the inverting signal INV N and INV N+1.

The gate signal output part 380 may include a first gate switching element T6A, a second gate switching element T7A and a third gate switching element T8A.

The first gate switching element T6A may include a control electrode connected to the Q node QN, an input electrode receiving the gate clock signal SC-CK N and an output electrode connected to a gate signal output terminal.

The second gate switching element T7A may include a control electrode receiving the inverting signal INV N+1 of the (N+1)-th stage, an input electrode connected to the gate signal output terminal and an output electrode receiving the third low voltage VSS3.

The third gate switching element T8A may include a control electrode receiving the inverting signal INV N, an input electrode connected to the gate signal output terminal and an output electrode receiving the third low voltage VSS3.

The gate signal output part 380 may further include a gate capacitor C1A connected between the control electrode of the first gate switching element T6A and the output electrode of the first gate switching element T6A.

The switching element stabilizing part 390 transmits the sixth input signal S6 to a connecting node of series connected switching elements to stabilize operations of the series connected switching elements.

The switching element stabilizing part 390 may include a switching element stabilizing switching element T28A.

The switching element stabilizing switching element T28A may include a control electrode connected to the Q node QN, an input electrode receiving the sixth input signal S6 and an output electrode connected to the output electrode of the first charging switching element T4-1A. The output electrode of the switching element stabilizing switching element T28A may be commonly connected to a connecting node of the first charging switching element T4-1A and the second charging switching element T4-2A, a connecting node of the first stabilizing switching element T1-1A and the second stabilizing switching element T1-2A, a connecting node of the third stabilizing switching element T2-1A and the fourth stabilizing switching element T2-2A, a connecting node of the first inverting stabilizing switching element T3-1A and the second inverting switching element T3-2A and a connecting node of the fourth inverting stabilizing switching element T5-1A and the fifth inverting switching element T5-2A.

The N-th stage and the (N+1)-th stage in FIG. 3 may form the stage pair. As shown in FIG. 3, the (N+1)-th stage may have a circuit structure which is mirrored from a circuit structure of the N-th stage.

When the third input signal S3 is applied to a first element of the N-th stage, the fourth input signal S4 may be applied to a second element of the (N+1)-th stage corresponding to the first element of the N-th stage.

In addition, the carry signal CR N+4 of the fourth next stage from the present stage is applied to the third stabilizing switching element T2-1A and the fourth stabilizing switching element T2-2A of the Q node stabilizing part 240 of the N-th stage through the IN N+4 terminal. In contrast, the carry signal CR N+4 of the third next stage from the present stage is applied to the third stabilizing switching element T2-1B and the fourth stabilizing switching element T2-2B of the Q node stabilizing part 240 of the (N+1)-th stage through the IN N+3 terminal.

As shown in FIG. 4, the N-th stage may be operated in response to the first clock signal CK1, first to third horizontal periods may be START period, fourth to tenth horizontal periods may be Q NODE HIGH period where the Q node signal Q[N] has a high level, a seventh horizontal period may be a gate output period and from eleventh horizontal period to a start of a vertical blank period VBLANK may be HOLD period. The vertical blank period VBLANK starts at a point where the second input signal S2 has a high level. During the vertical blank period VBLANK, the characteristic of the switching element of the pixel part may be sensed by the first sensing part 310 and the second sensing part 320.

As shown in FIG. 5, during the Q NODE HIGH period, the inverting signal INV has a low level. When the inverting signal INV become a high level, the carry signal output part 360 pulls down the level of the carry signal CR N to the first low level VSS1. When the inverting signal INV become a high level, the sensing signal output part 370 and the gate signal output part 380 pull down the level of the sensing signal SS N and the level of the gate signal SC N to the first low level VSS1.

The Q node charging part 330 of the N-th stage charges the Q node QN based on one (e.g. In N−3) of the previous carry signals. The Q node stabilizing part 340 of the N-th stage stabilizes the Q node QN based on one (e.g. In N+4) of the next carry signals.

Figure 6:
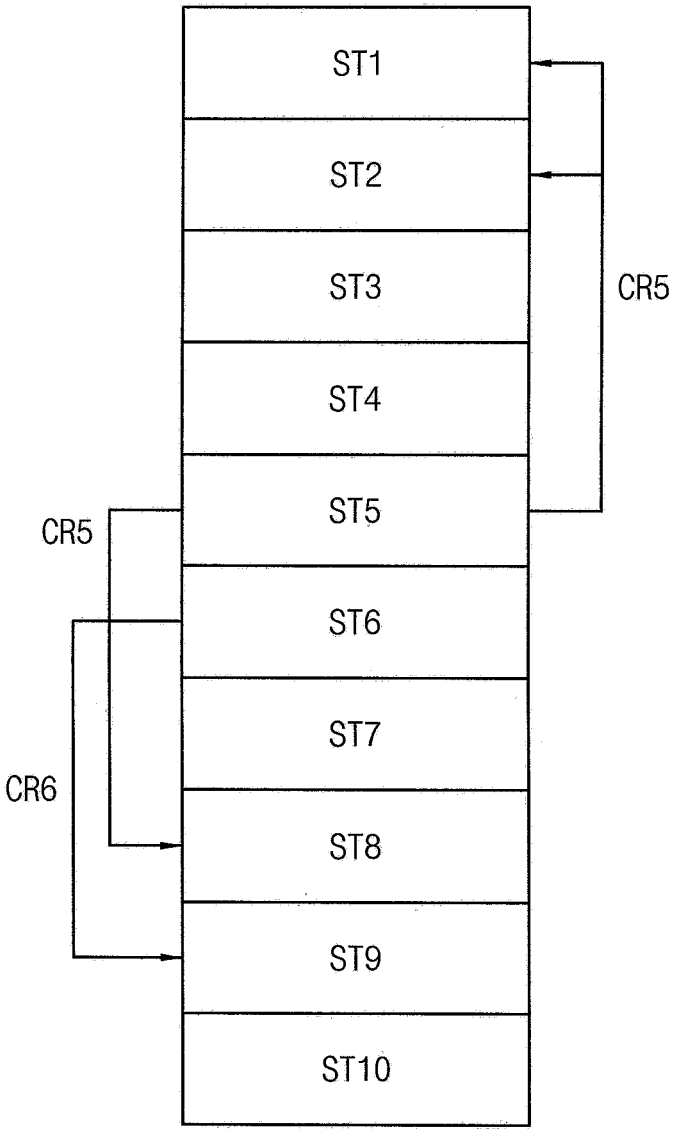
FIG. 6 is a block diagram illustrating stages receiving a carry signal outputted from a fifth stage of the gate driver of FIG. 1.
Figure 7:
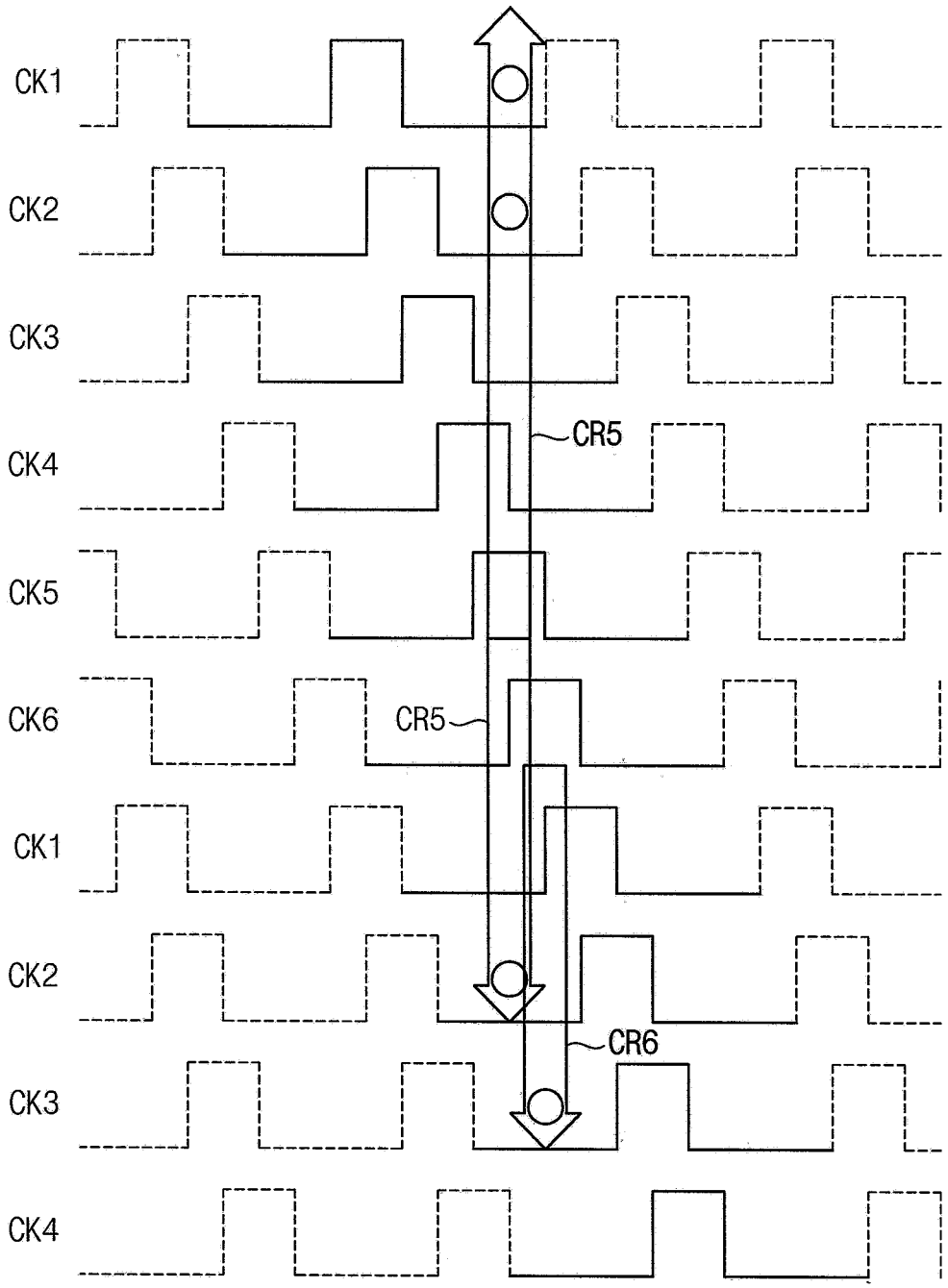
FIG. 7 is a timing diagram illustrating stages receiving the carry signal outputted from a fifth stage of the gate driver of FIG. 1.
Figure 8:
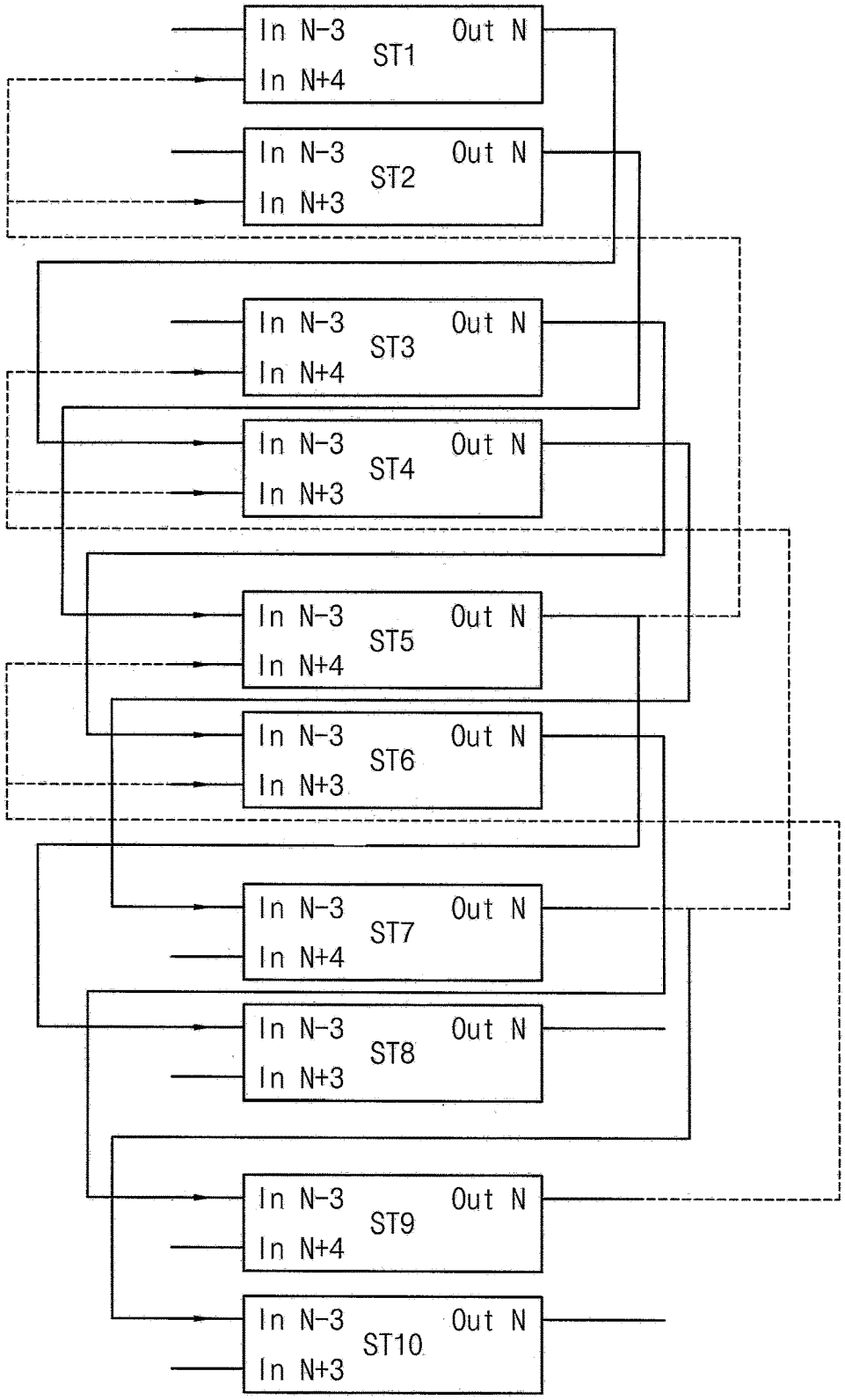
FIG. 8 is a block diagram illustrating carry transmitting lines across stages of the gate driver of FIG. 1.

FIG. 6 is a block diagram illustrating stages receiving a carry signal CR5 outputted from a fifth stage ST5 of the gate driver 300 of FIG. 1. FIG. 7 is a timing diagram illustrating stages receiving the carry signal CR5 outputted from a fifth stage ST5 of the gate driver 300 of FIG. 1. FIG. 8 is a block diagram illustrating carry transmitting lines across stages of the gate driver 300 of FIG. 1.

Referring to FIGS. 1-8, transmission of the carry signal across the stages is explained with respect to the fifth stage ST5 for convenience of explanation. For example, the fifth stage ST5 and the sixth stage ST6 may form a stage pair.

The fifth stage ST5 may output the carry signal CR5 to the Q node stabilizing part 340 of the first stage ST1 and the Q node stabilizing part 340 of the second stage ST2 to stabilize the Q node of the first stage ST1 and the Q node of the second stage ST2 to a low level.

The fifth stage ST5 may output the carry signal CR5 to the Q node charging part 330 of the eighth stage ST8 to charge the Q node of the eighth stage ST8 to a high level.

The sixth stage ST6 may output the carry signal CR6 to the Q node charging part 330 of the ninth stage ST9 to charge the Q node of the ninth stage ST9 to a high level.

The clock signals CK1 to CK6 and CK1 to CK4 that are applied (e.g., sequentially applied) to the first to tenth stages ST1 to ST10 are represented in FIG. 7. In addition, the timing of the carry signal CR5 of the fifth stage ST5 transmitted to the first, second and eighth stages ST1, ST2 and ST8 is represented in FIG. 7.

The carry signal output lines transmitting the carry signal across the stages are represented in FIG. 8.

Figure 9:
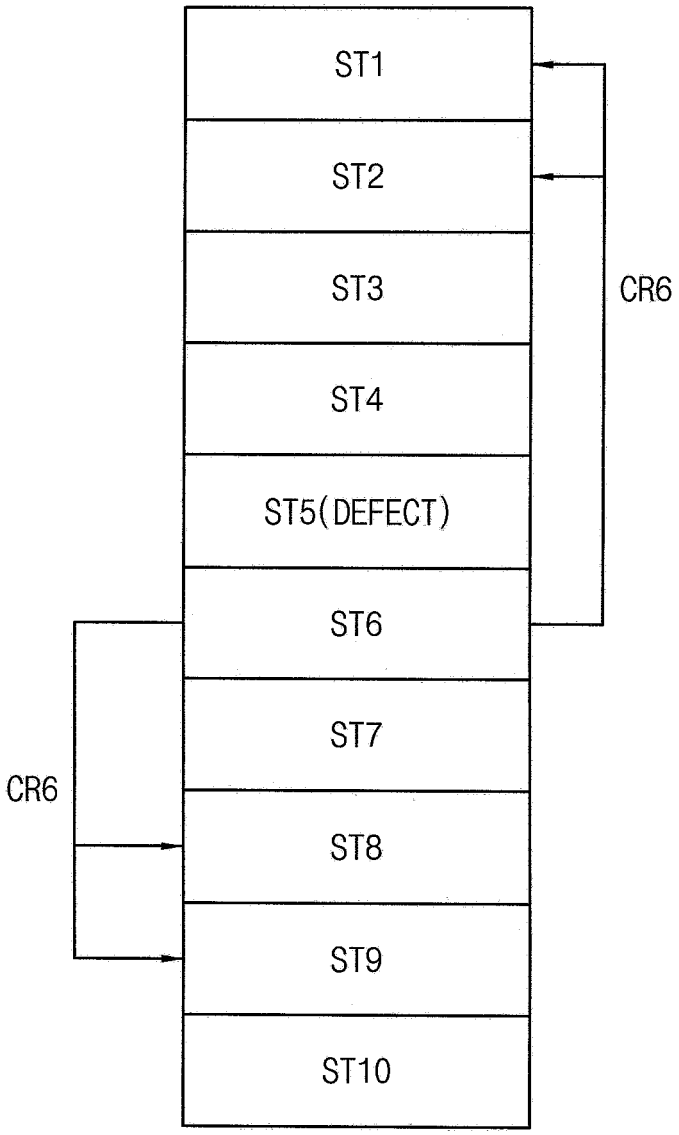
FIG. 9 is a block diagram illustrating stages receiving a carry signal outputted from a sixth stage of the gate driver of FIG. 1 when the carry signal outputted from the fifth stage of the gate driver of FIG. 1 has a defect.
Figure 10:
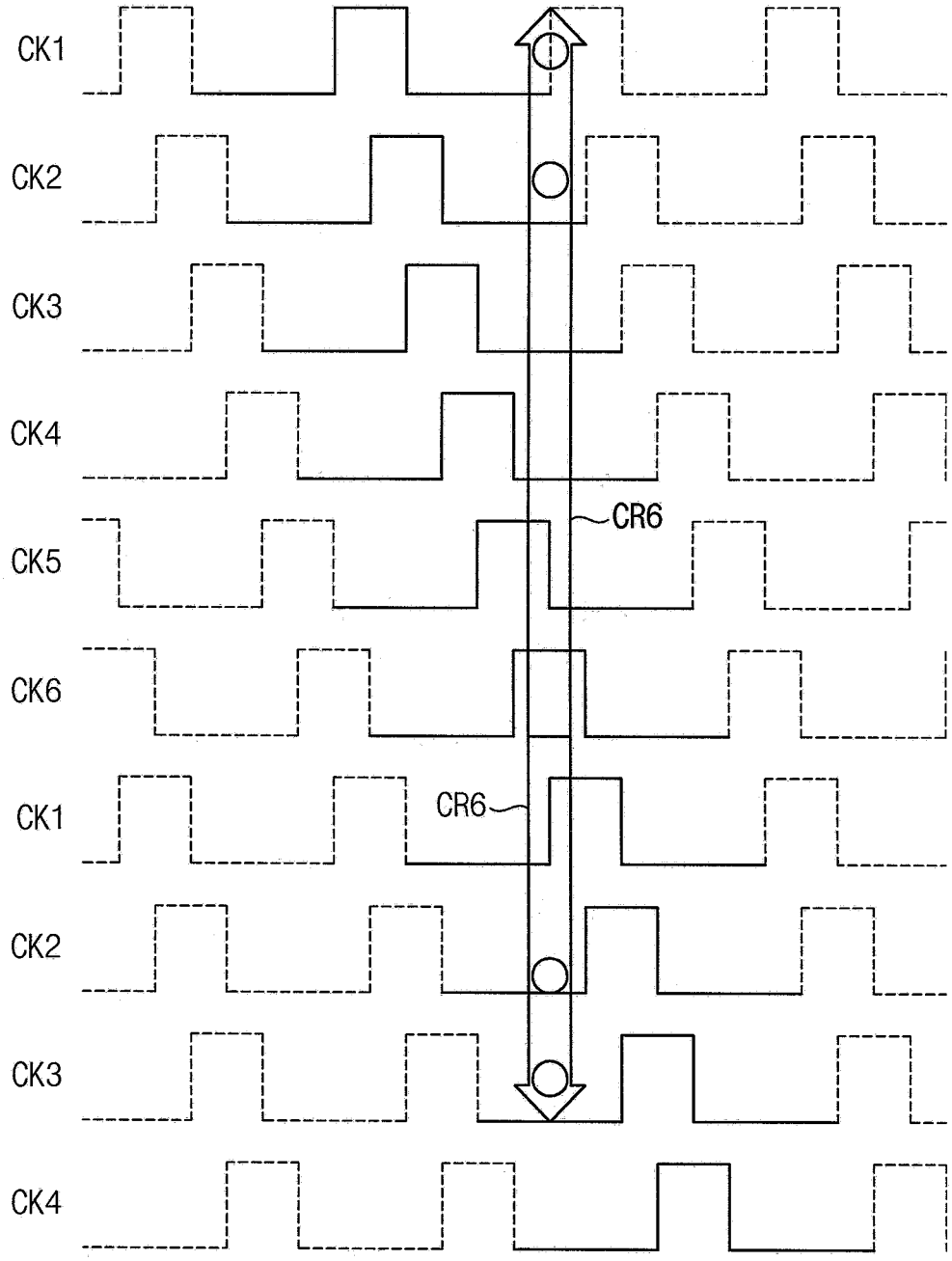
FIG. 10 is a timing diagram illustrating stages receiving the carry signal outputted from the sixth stage of the gate driver of FIG. 1 when the carry signal outputted from the fifth stage of the gate driver of FIG. 1 has a defect.
Figure 11:
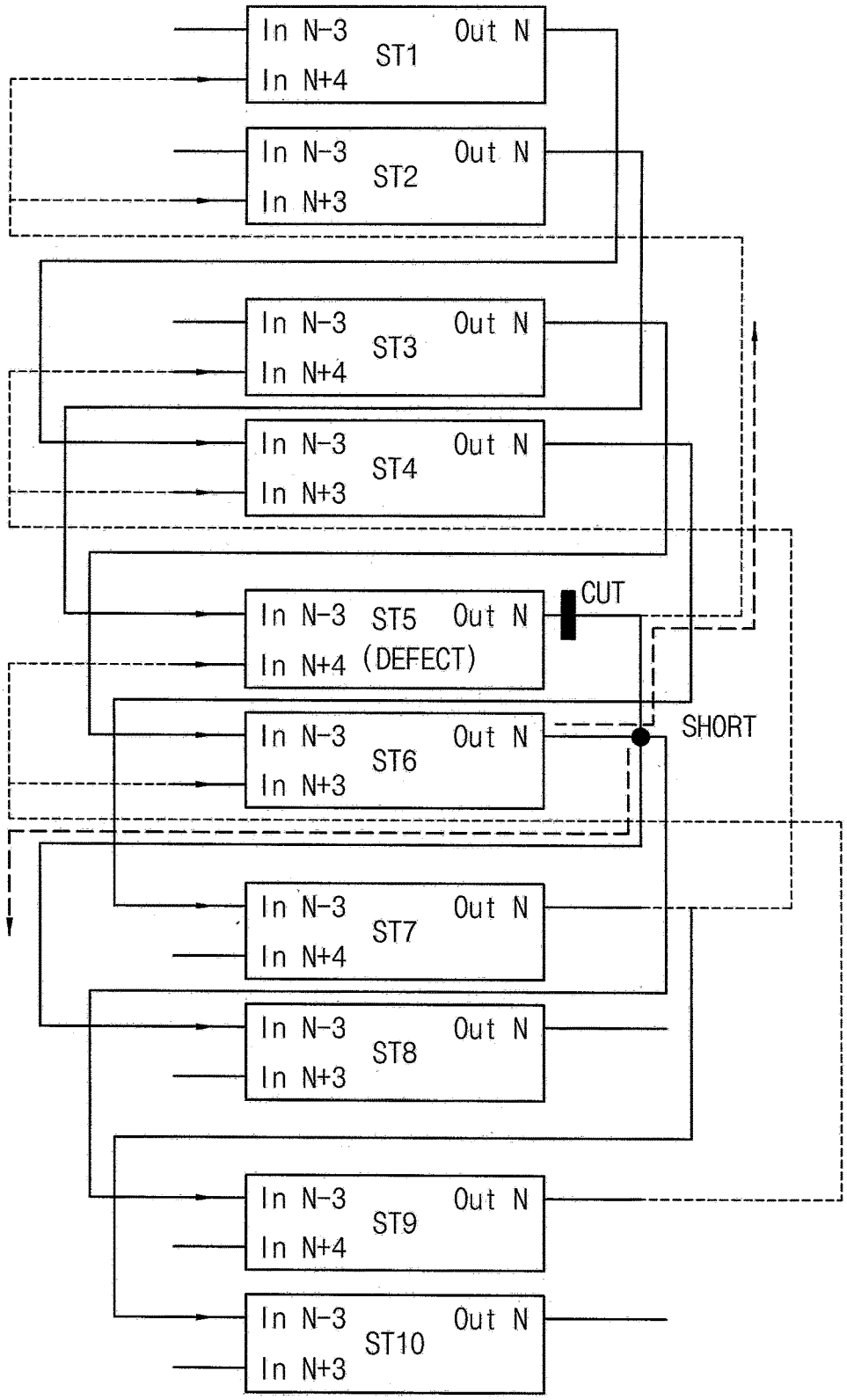
FIG. 11 is a block diagram illustrating carry transmitting lines across stages of the gate driver of FIG. 1 when the carry signal outputted from the fifth stage of the gate driver of FIG. 1 has a defect.

FIG. 9 is a block diagram illustrating stages receiving a carry signal CR6 outputted from a sixth stage ST6 of the gate driver 300 of FIG. 1 when the carry signal CR5 outputted from the fifth stage ST5 of the gate driver 300 of FIG. 1 has a defect. FIG. 10 is a timing diagram illustrating stages receiving the carry signal CR6 outputted from the sixth stage ST6 of the gate driver 300 of FIG. 1 when the carry signal CR5 outputted from the fifth stage ST5 of the gate driver 300 of FIG. 1 has a defect. FIG. 11 is a block diagram illustrating carry transmitting lines across stages of the gate driver 300 of FIG. 1 when the carry signal CR5 outputted from the fifth stage ST5 of the gate driver 300 of FIG. 1 has a defect.

Referring to FIGS. 1-11, transmission of the carry signal across the stages is explained with respect to the fifth stage ST5 for convenience of explanation. Herein, the fifth stage ST5 and the sixth stage ST6 may form a stage pair.

In the present exemplary embodiment, a defect may have occurred at the carry signal CR5 of the fifth stage ST5. When the defect has occurred at the carry signal CR5 of the fifth stage ST5, the gate driver 500 may be repaired using the carry signal CR6 of the sixth stage ST6.

Thus, the first, second and eighth stages ST1, ST2 and ST8 may receive the carry signal CR6 of the sixth stage ST6 instead of the carry signal CR5 of the fifth stage ST5 due to a false operation of the carry signal output part 360 of the fifth stage ST5.

The sixth stage ST6 may output the carry signal CR6 to the Q node stabilizing part 340 of the first stage ST1 and the Q node stabilizing part 340 of the second stage ST2 to stabilize the Q node of the first stage ST1 and the Q node of the second stage ST2 to a low level.

The sixth stage ST6 may output the carry signal CR6 to the Q node charging part 330 of the eighth stage ST8 and the Q node charging part 330 of the ninth stage ST9 to charge the Q node of the eighth stage ST8 and the Q node of the eighth stage ST9 to a high level.

The clock signals CK1 to CK6 and CK1 to CK4 applied (e.g., sequentially applied) to the first to tenth stages ST1 to ST10 are represented in FIG. 10. In addition, the timing of the carry signal CR6 of the sixth stage ST6 transmitted to the first, second, eighth and ninth stages ST1, ST2, ST8 and ST9 is represented in FIG. 10.

In the present exemplary embodiment, the carry signal CR6 of the sixth stage ST6 may be transmitted to the first, second and eighth stages ST1, ST2 and ST8 instead of the carry signal CR5 of the fifth stage ST5. The carry signal CR6 of the sixth stage ST6 may be later than the carry signal CR5 of the fifth stage ST5 by one horizontal period. Referring to FIGS. 4 and 5, although the first, second and eighth stages ST1, ST2 and ST8 receive the carry signal having a timing that is later by one horizontal period, the first, second and eighth stages ST1, ST2 and ST8 may be normally operated because the Q NODE HIGH period corresponds to seven horizontal periods.

The carry signal output lines transmitting the carry signal across the stages are represented in FIG. 11. When the defect is occurred at the carry signal CR5 of the fifth stage ST5, the carry signal output terminal of the fifth stage ST5 may be opened and a carry transmitting line of the fifth stage ST5 and a carry transmitting line of the sixth stage ST6 may be shorted at a cross point of the carry transmitting line of the fifth stage ST5 and the carry transmitting line of the sixth stage ST6 so that the carry signal CR6 of the sixth stage ST6 may be applied to the stages through the carry transmitting line of the fifth stage ST5.

Figure 12:
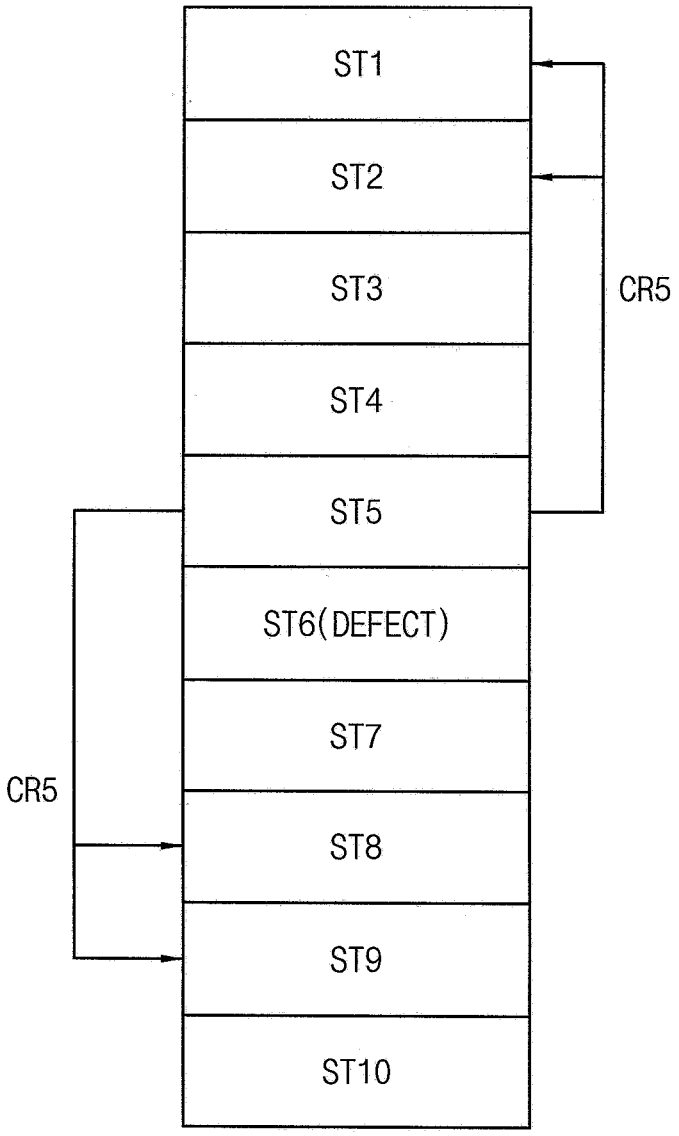
FIG. 12 is a block diagram illustrating stages receiving a carry signal outputted from the fifth stage of the gate driver of FIG. 1 when the carry signal outputted from the sixth stage of the gate driver of FIG. 1 has a defect.
Figure 13:
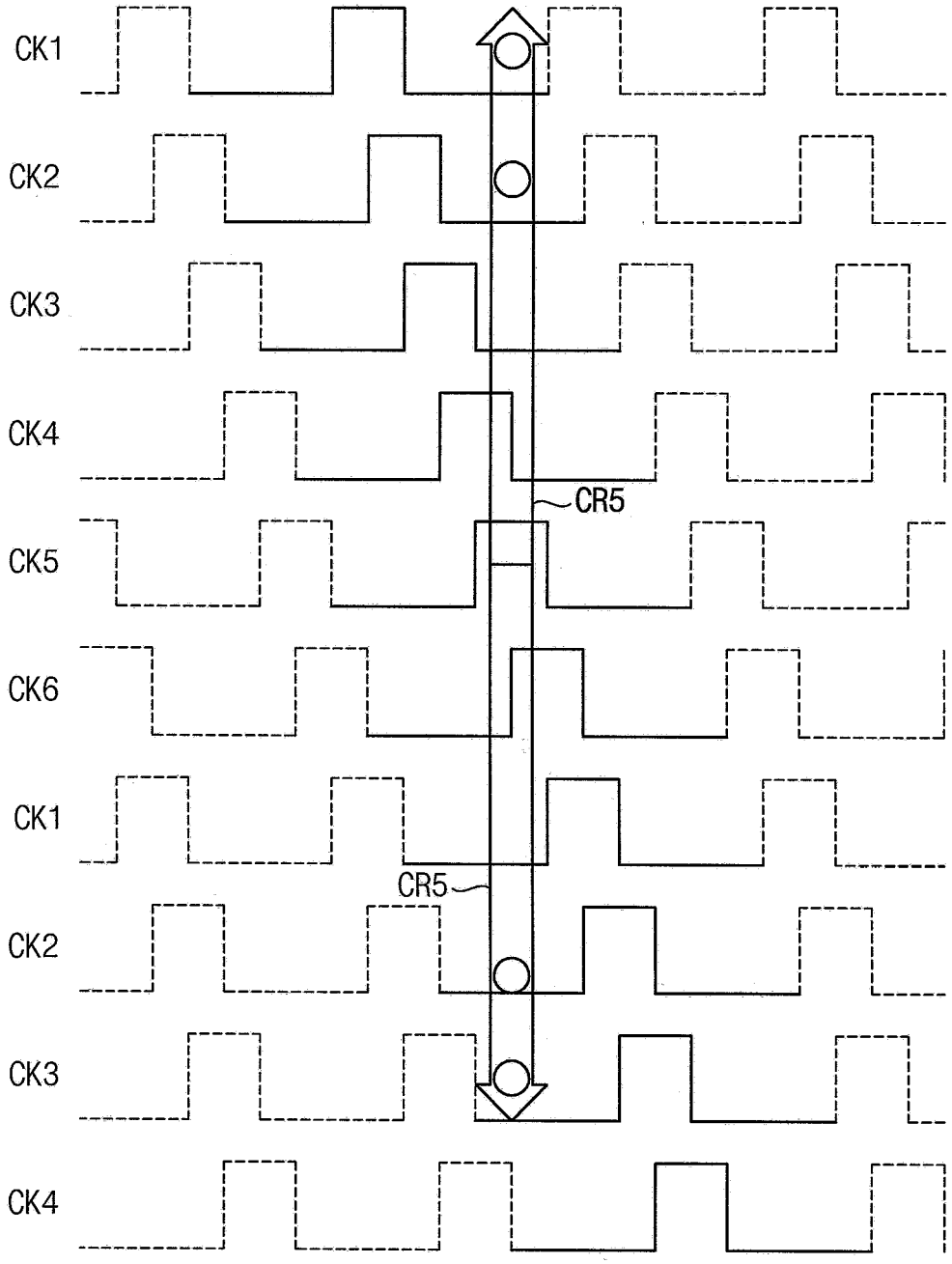
FIG. 13 is a timing diagram illustrating stages receiving the carry signal outputted from the fifth stage of the gate driver of FIG. 1 when the carry signal outputted from the sixth stage of the gate driver of FIG. 1 has a defect.
Figure 14:
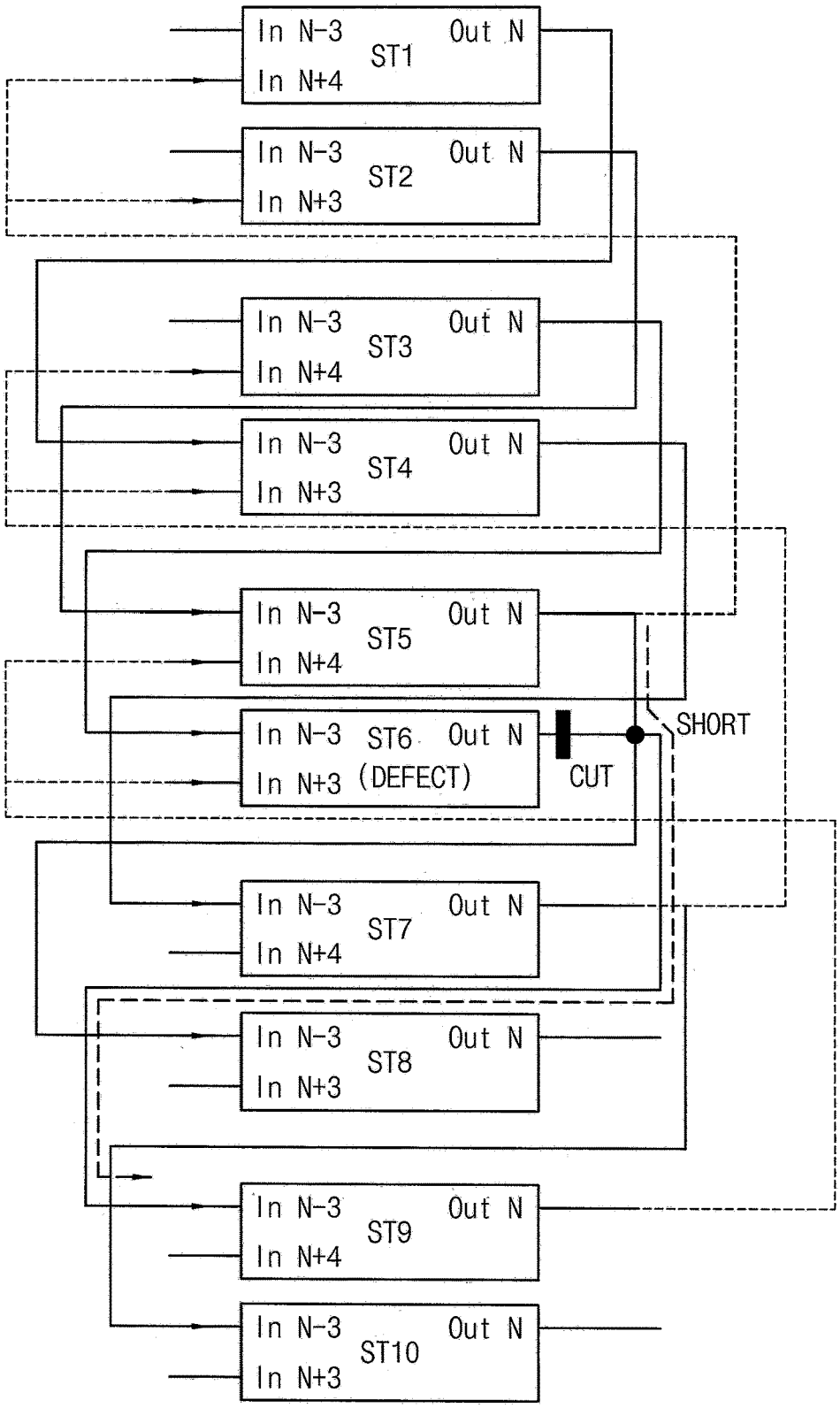
FIG. 14 is a block diagram illustrating carry transmitting lines across stages of the gate driver of FIG. 1 when the carry signal outputted from the sixth stage of the gate driver of FIG. 1 has a defect.

FIG. 12 is a block diagram illustrating stages receiving the carry signal CR5 outputted from the fifth stage ST5 of the gate driver 300 of FIG. 1 when the carry signal CR6 outputted from the sixth stage ST6 of the gate driver 300 of FIG. 1 has a defect. FIG. 13 is a timing diagram illustrating stages receiving the carry signal CR5 outputted from the fifth stage ST5 of the gate driver 300 of FIG. 1 when the carry signal CR6 outputted from the sixth stage ST6 of the gate driver 300 of FIG. 1 has a defect. FIG. 14 is a block diagram illustrating carry transmitting lines across stages of the gate driver 300 of FIG. 1 when the carry signal CR6 outputted from the sixth stage ST6 of the gate driver 300 of FIG. 1 has a defect.

Referring to FIGS. 1-14, the transmission of the carry signal across the stages is explained with respect to the fifth stage ST5 for convenience of explanation. For example, the fifth stage ST5 and the sixth stage ST6 may form a stage pair.

In the present exemplary embodiment, a defect may be occurred at the carry signal CR6 of the sixth stage ST6. When the defect is occurred at the carry signal CR6 of the sixth stage ST6, the gate driver 500 may be repaired using the carry signal CR5 of the fifth stage ST5.

For Example, the ninth stage ST9 may receive the carry signal CR5 of the fifth stage ST5 instead of the carry signal CR6 of the sixth stage ST6 due to a false operation of the carry signal output part 360 of the sixth stage ST6.

The fifth stage ST5 may output the carry signal CR5 to the Q node stabilizing part 340 of the first stage ST1 and the Q node stabilizing part 340 of the second stage ST2 to stabilize the Q node of the first stage ST1 and the Q node of the second stage ST2 to a low level.

The fifth stage ST5 may output the carry signal CR5 to the Q node charging part 330 of the eighth stage ST8 and the Q node charging part 330 of the ninth stage ST9 to charge the Q node of the eighth stage ST8 and the Q node of the eighth stage ST9 to a high level.

The clock signals CK1 to CK6 and CK1 to CK4 applied (e.g., sequentially applied) to the first to tenth stages ST1 to ST10 are represented in FIG. 13. In addition, the timing of the carry signal CR5 of the fifth stage ST5 transmitted to the first, second, eighth and ninth stages ST1, ST2, ST8 and ST9 is represented in FIG. 13.

In the present exemplary embodiment, the carry signal CR5 of the fifth stage ST5 may be transmitted to the ninth stage ST9 instead of the carry signal CR6 of the sixth stage ST6. The carry signal CR5 of the fifth stage ST5 may be earlier than the carry signal CR6 of the sixth stage ST6 by one horizontal period. Referring to FIGS. 4 and 5, although the ninth stage ST9 receives the carry signal having a timing earlier by one horizontal period, the ninth stage ST9 may be normally operated because the Q NODE HIGH period corresponds to seven horizontal periods.

The carry signal output lines transmitting the carry signal across the stages are represented in FIG. 14. When the defect is occurred at the carry signal CR6 of the sixth stage ST6, the carry signal output terminal of the sixth stage ST6 may be opened and a carry transmitting line of the fifth stage ST5 and a carry transmitting line of the sixth stage ST6 may be shorted at a cross point of the carry transmitting line of the fifth stage ST5 and a carry transmitting line of the sixth stage ST6 so that the carry signal CR5 of the fifth stage ST5 may be applied to the stages through the carry transmitting line of the sixth stage ST6.

According to the present exemplary embodiment, when a defect has occurred at the carry signal of the stage in the stage pair, the carry signal of the stage having the defect may be repaired by a carry signal of another stage in the stage pair. Thus, the gate driving circuit 300 having the defected carry signal output part, and a structure including the gate driving circuit 300 may not need to be discarded. Thus, the manufacturing cost of the display apparatus may be reduced.

According to the present inventive concept as explained above, the manufacturing cost of the display apparatus may be reduced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A gate driving circuit comprising a plurality of stages, wherein adjacent two stages from among the plurality of stages constitute a stage pair, wherein the adjacent two stages in the stage pair include switching elements that are connected with each other, wherein when a carry signal of an N-th stage in the stage pair has a defect, the N-th stage is configured to output a carry signal of an (N+1)-th stage in the stage pair, and wherein N is a positive integer, wherein the N-th stage comprises: a Q node charging circuit configured to charge a Q node based on one of previous carry signals; a Q node stabilizing circuit configured to stabilize the Q node based on one of next carry signals; a carry signal output circuit configured to output a carry signal based on a Q node signal of the Q node; a sensing signal output circuit configured to output a sensing signal based on the Q node signal; and a gate signal output circuit configured to output a gate signal based on the Q node signal.

2. The gate driving circuit of claim 1, wherein the Q node charging circuit comprises: a first charging switching element comprising a control electrode configured to receive one of the previous carry signals, an input electrode configured to receive one of the previous carry signals} and an output electrode; and a second charging switching element comprising a control electrode configured to receive one of the previous carry signals, an input electrode connected to the output electrode of the first charging switching element and an output electrode connected to the Q node.

3. The gate driving circuit of claim 2, wherein one of the previous carry signals is a carry signal of a third previous stage from a present stage.

4. The gate driving circuit of claim 1, wherein the Q node stabilizing circuit comprises: a first stabilizing switching element comprising a control electrode configured to receive a fifth input signal, an input electrode, and an output electrode configured to receive a first low voltage; a second stabilizing switching element comprising a control electrode configured to receive the fifth input signal, an input electrode connected to the Q node and an output electrode connected to the input electrode of the first stabilizing switching element; a third stabilizing switching element comprising a control electrode configured to receive one of the next carry signals, an input electrode, and an output electrode configured to receive the first low voltage; and a fourth stabilizing switching element comprising a control electrode configured to receive one of the next carry signals, an input electrode connected to the Q node, and an output electrode connected to the input electrode of the third stabilizing switching element.

5. The gate driving circuit of claim 4, wherein when a present stage is the N-th stage, one of the next carry signals is a carry signal of a fourth next stage from the present stage.

6. The gate driving circuit of claim 4, wherein when a present stage is the (N+1)-th stage, one of the next carry signals is a carry signal of a third next stage from the present stage.

7. The gate driving circuit of claim 1, wherein the gate driving circuit comprises first, second, third, fourth, fifth, sixth, seventh, eighth, ninth and tenth stages, wherein when a carry signal of the fifth stage and a carry signal of the sixth stage are in a normal status, the carry signal of the fifth stage is to be applied to a Q node stabilizing circuit of the first stage, a Q node stabilizing circuit of the second stage and a Q node charging circuit of the eighth stage and the carry signal of the sixth stage is to be applied to a Q node charging circuit of the ninth stage.

8. The gate driving circuit of claim 7, wherein when the carry signal of the fifth stage has a defect and the carry signal of the sixth stage is in a normal status, the carry signal of the sixth stage is to be applied to the Q node stabilizing circuit of the first stage, the Q node stabilizing circuit of the second stage, the Q node charging circuit of the eighth stage and the Q node charging circuit of the ninth stage.

9. The gate driving circuit of claim 8, wherein when the carry signal of the fifth stage has a defect and the carry signal of the sixth stage is in a normal status, a carry signal output terminal of the fifth stage is to be opened and a carry transmitting line of the fifth stage and a carry transmitting line of the sixth stage are to be shorted at a cross point of the carry transmitting line of the fifth stage and the carry transmitting line of the sixth stage.

10. The gate driving circuit of claim 7, wherein when the carry signal of the fifth stage is in a normal status and a carry signal of the sixth stage has a defect, the carry signal of the fifth stage is to be applied to the Q node stabilizing circuit of the first stage, the Q node stabilizing circuit of the second stage, the Q node charging circuit of the eighth stage and the Q node charging circuit of the ninth stage.

11. The gate driving circuit of claim 10, wherein when the carry signal of the fifth stage is in a normal status and a carry signal of the sixth stage has a defect, a carry signal output terminal of the sixth stage is to be opened and a carry transmitting line of the fifth stage and a carry transmitting line of the sixth stage are to be shorted at a cross point of the carry transmitting line of the fifth stage and the carry transmitting line of the sixth stage.

12. The gate driving circuit of claim 1, wherein the carry signal output circuit comprises: a first carry switching element comprising a control electrode connected to the Q node, an input electrode configured to receive a carry clock signal and an output electrode connected to a carry signal output terminal; a second carry switching element comprising a control electrode configured to receive an inverting signal of the (N+1)-th stage, an input electrode connected to the carry signal output terminal and an output electrode configured to receive a first low voltage; and a third carry switching element comprising a control electrode configured to receive the inverting signal of the N-th stage, an input electrode connected to the carry signal output terminal and an output electrode configured to receive the first low voltage.

13. The gate driving circuit of claim 1, wherein the sensing signal output circuit comprises: a first sensing output switching element comprising a control electrode connected to the Q node, an input electrode configured to receive a sensing clock signal and an output electrode connected to a sensing signal output terminal; a second sensing output switching element comprising a control electrode configured to receive an inverting signal of the (N+1)-th stage, an input electrode connected to the sensing signal output terminal and an output electrode configured to receive a third low voltage; and a third sensing output switching element comprising a control electrode configured to receive an inverting signal of the N-th stage, an input electrode connected to the sensing signal output terminal and an output electrode receiving the third low voltage.

14. The gate driving circuit of claim 1, wherein the gate signal output circuit comprises: a first gate switching element comprising a control electrode connected to the Q node, an input electrode configured to receive a gate clock signal and an output electrode connected to a gate signal output terminal; a second gate switching element comprising a control electrode configured to receive an inverting signal of the (N+1)-th stage, an input electrode connected to the gate signal output terminal and an output electrode configured to receive a third low voltage; and a third gate switching element comprising a control electrode configured to receive an inverting signal of the N-th stage, an input electrode connected to the gate signal output terminal and an output electrode configured to receive the third low voltage.

15. A display apparatus comprising: a display panel configured to display an image; a gate driver configured to output a gate signal to the display panel; and a data driver configured to output a data voltage to the display panel, wherein the gate driver comprises a plurality of stages, wherein adjacent two stages from among the plurality of stages in the gate driver constitute a stage pair, wherein the adjacent two stages in the stage pair include switching elements connected with each other, wherein when a carry signal of an N-th stage in the stage pair has a defect, the N-th stage is configured to output a carry signal of an (N+1)-th stage in the stage pair, and wherein N is a positive integer, wherein the N-th stage comprises: a Q node charging circuit configured to charge a Q node based on one of previous carry signals; a Q node stabilizing circuit configured to stabilize the Q node based on one of next carry signals; a carry signal output circuit configured to output a carry signal based on a Q node signal of the Q node; a sensing signal output circuit configured to output a sensing signal based on the Q node signal; and a gate signal output circuit configured to output a gate signal based on the Q node signal.

16. The display apparatus of claim 15, wherein the Q node charging circuit comprises: a first charging switching element comprising a control electrode configured to receive one of the previous carry signals, an input electrode configured to receive one of the previous carry signals, and an output electrode; and a second charging switching element comprising a control electrode configured to receive one of the previous carry signals, an input electrode connected to the output electrode of the first charging switching element, and an output electrode connected to the Q node.

17. The display apparatus of claim 15, wherein the Q node stabilizing circuit comprises: a first stabilizing switching element comprising a control electrode configured to receive a fifth input signal, an input electrode, and an output electrode configured to receive a first low voltage; a second stabilizing switching element comprising a control electrode configured to receive the fifth input signal, an input electrode connected to the Q node, and an output electrode connected to the input electrode of the first stabilizing switching element; a third stabilizing switching element comprising a control electrode configured to receive one of the next carry signals, an input electrode, and an output electrode configured to receive the first low voltage; and a fourth stabilizing switching element comprising a control electrode configured to receive one of the next carry signals, an input electrode connected to the Q node, and an output electrode connected to the input electrode of the third stabilizing switching element.

* * * * *